US006250514B1

(12) United States Patent
Hansson

(10) Patent No.: US 6,250,514 B1
(45) Date of Patent: Jun. 26, 2001

(54) CONTAINER FOR STORING AND DISCHARGING PARTICULATE MATERIAL, IN PARTICULAR PULP CHIPS

(75) Inventor: Stefan Hansson, Karlstad (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/454,790

(22) Filed: Dec. 3, 1999

(30) Foreign Application Priority Data

Dec. 15, 1998 (SE) ..... 9804318

(51) Int. Cl.[7] ..... B65D 88/00

(52) U.S. Cl. ..... 222/462; 222/185.1; 222/460; 222/564; 414/287; 193/2 R; 193/3; 52/197

(58) Field of Search ..... 222/185.1, 460–462, 222/564; 141/331, 333, 334, 339; 52/192, 195, 197; 414/287; 193/2 R, 3–5; 162/246

(56) References Cited

U.S. PATENT DOCUMENTS 4,958,741 * 9/1990 Joahnson ..... 222/460
5,992,699 * 11/1999 Johnson et al. ..... 222/185.1
6,055,781 * 5/2000 Johanson ..... 52/197
6,089,417 * 7/2000 Snekkenes et al. ..... 222/460

* cited by examiner

*Primary Examiner*—J. Casimer Jacyna
(74) *Attorney, Agent, or Firm*—Fasth Law Offices; Rolf Fasth

(57) ABSTRACT

The present invention relates to a container for storing and discharging particulate material, in particular pulp chips.

For the purpose of preventing bridge formation and making possible a simple and cost-effective design, the container is made so that a positive release is achieved in different transverse directions, after which the material is fed down towards the discharge end 2.

The container 1 preferably has a rectangular cross section, with a number of container sections $BS_1$–$BS_8$ in succession from the infeed end 4 of the container to its discharge end 2.

Two opposite sides in each container section are given a diverging deflection (5°) relative to the discharge end 2, and the other opposite sides in each container section are given a converging deflection (29°). In following container sections, converging sides change to diverging sides and vice versa, which results in the positive release of the material being achieved alternately with a 90° displacement.

10 Claims, 1 Drawing Sheet

CONTAINER FOR STORING AND DISCHARGING PARTICULATE MATERIAL, IN PARTICULAR PULP CHIPS

TECHNICAL FIELD

The present invention relates to a container for storing and discharging particulate material, in particular pulp chips.

BACKGROUND AND SUMMARY OF THE INVENTION

Within the pulp industry, use is made of temporary containers for pulp chips at various stages of processing. These containers, known as chip bins within the pulp sector, are required to be designed in such a manner that the material does not form bridges or lumps in the container. A large number of chip bins are known for the purpose of counteracting such lump formation. Some are equipped with vibration arrangements, frequently referred to as Vibra Bins, which subject the container to vibrations, which is intended to break up any bridges before these are formed.

In other solutions, steam or air nozzles are arranged inside the container, by means of which nozzles it is possible to act on the chips intermittently with steam/air jets which break up the bridges. Examples of such arrangements are disclosed in U.S. Pat. No. 5,635,025, U.S. Pat. No. 5,628,873, U.S. Pat. No. 5,500,083. In these, additional equipment is required for the purpose of breaking up the bridges, which equipment makes the container more expensive and more complex and also increases the requirement for maintenance as a result of wear of component parts.

From U.S. Pat. No. 4,958,741, a basic design of a container is known, in which use is made of alternate round and oval sections of successively smaller cross section. In this case, it is stated that the basic designs themselves are to prevent the occurrence of bridges. However, the solution is relatively complicated to produce and is inadequately optimized from the point of view of strength.

Other basic designs of chip bins are known from U.S. Pat. No. 5,476,572 and U.S. Pat. No. 5,361,945. SE C 505498 discloses another variant in which the pulp is imparted a deflection in changing directions.

It is obvious that the problem of trouble-free feed from chip bins is a major problem, and that relatively complicated designs have been proposed, often with expensive additional equipment such as vibration arrangements and nozzles.

The present invention aims to provide a chip bin of simpler design which can be produced at a lower cost. A design according to the invention makes it possible for the container to be produced as a simple construction of plane plates.

A further object is that chip bridge formation inside the container is counteracted by means of the design of the container, in which a positive release can be achieved at all levels in at least one direction horizontally.

As a result, a more reliable discharge of chips can be achieved, and any additional equipment in the form of nozzles or vibration arrangements does not need to be activated as often for the purpose of breaking up any bridges. In most cases, this additional equipment can be dispensed with altogether.

The invention is described in greater detail by means of embodiments and with reference to the figures as below.

DETAILED DESCRIPTION OF PREFERRED EMBODIMENTS

Figure 1:
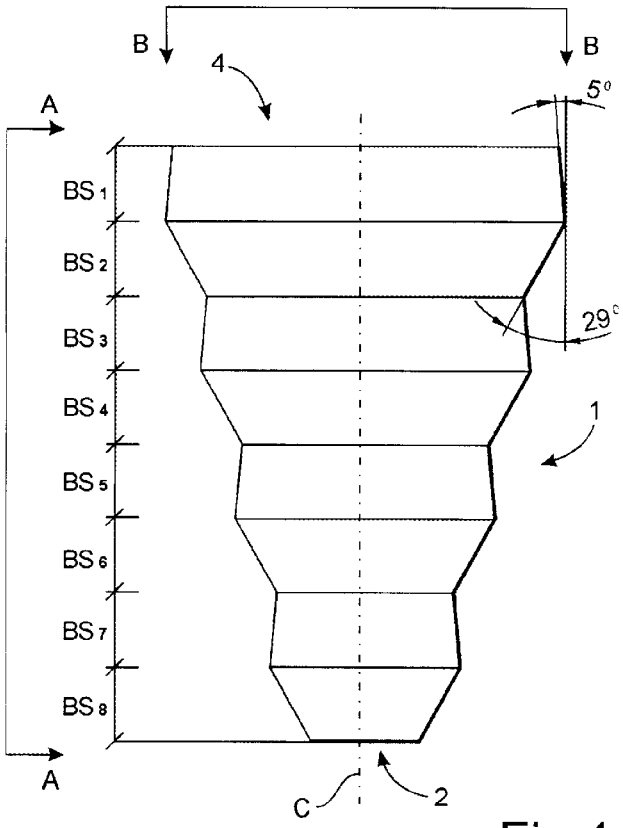
FIG. 1 shows a chip bin according to the invention in a side view.

FIG. 1 shows a chip bin seen in a side view. Chips are fed to an upper infeed end 4 by a suitable feed arrangement. The chip bin can have either an open upper part where chips are tipped down into the infeed end, or alternatively a closed upper part where a feed line supplies chips to the upper part of the chip bin. After an appropriate dwell time for the chips in the chip bin, or alternatively when subsequent processes require charging with chips, the chips are then discharged from the lower discharge end 2 of the chip bin.

According to the invention, the chip bin is provided with a number of container sections $BS_1$–$BS_N$, starting from the infeed end of the chip bin. Each container section $BS_N$ is constructed from plane plates, in the figure four plane plates.

In the first upper container section $BS_1$, two opposite sides 6*a*, 6*b* are inclined so that they converge towards the discharge end 2. Each side converges at a deflection angle of the order of 20–45°, preferably 29°, in relation to the centre line C of the container.

The other two opposite sides 5*a*, 5*b* in the first upper container section $BS_1$ are inclined so that they instead diverge towards the discharge end 2. These sides diverge at a deflection angle of the order of 2–10°, preferably 5°, in relation to the centre line C of the container. In this way, a positive release of the chips is achieved in at least one transverse direction in the upper first container section $BS_1$.

Figure 2:
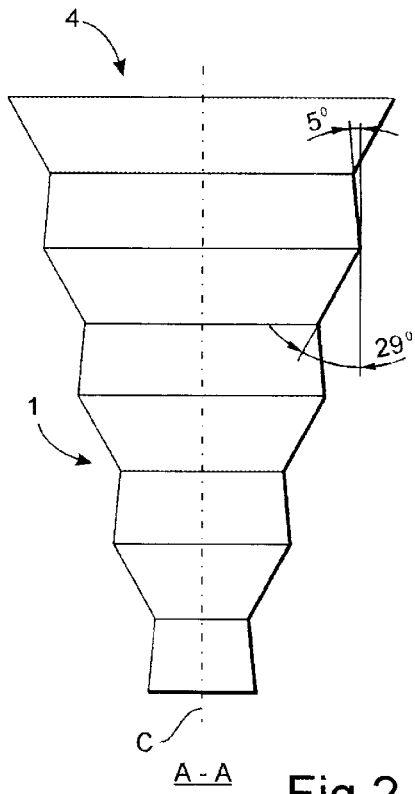
FIG. 2 shows a chip bin according to the invention seen in the view A—A in FIG. 1.
Figure 3:
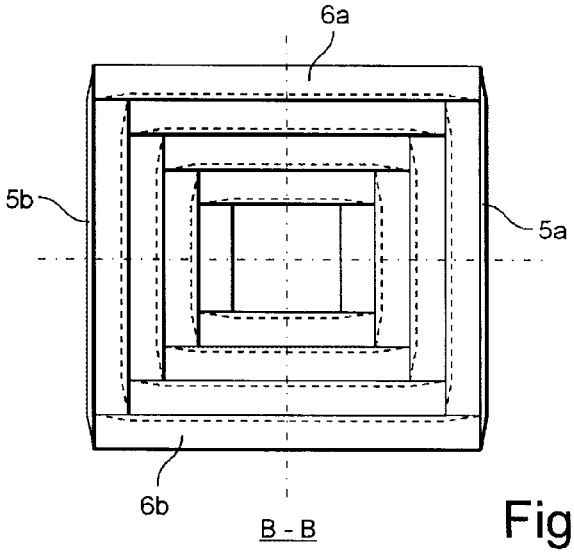
FIG. 3 shows a chip bin according to the invention seen in the view B—B in FIG. 1.

In the next container section $BS_2$, the converging sides from the preceding container section merge with a diverging deflection. Correspondingly, the diverging sides from the preceding container section merge with a converging deflection, which can be seen from FIG. 2. In this way, an alternating positive release of the chips in a changing transverse direction is achieved. In the embodiment shown, a positive release will be achieved in alternating directions rotated through 90° relative to one another and around the centre line C of the container. The occurrence of bridges in the chips is counteracted then by the design of the chip bin. The important factor is that each container section has an actual positive release in at least one direction and not just a deflection, which is the result if only one side of two opposite sides is imparted a diverging deflection seen relative to the discharge end of the chip bin, and these opposite sides together produce a convergence.

In the embodiment shown, there are eight container sections $BS_1$-$BS_8$, all the container sections having this positive release in at least one direction. Each container section has a successively smaller cross section seen from the infeed end 4 because the diverging deflection on opposite sides 5*a*, 5*b* in one direction clearly has a smaller extent than the converging deflection on opposite sides 6*a*, 6*b*.

The invention is not limited to the embodiment shown but can be varied in different ways within the scope of the appended patent claims.

For example, the polygonal cross section of the container can be given a hexagonal shape, where two opposite sides are given a positive release in turn, while the other two pairs of opposite sides are given a converging deflection. Between successive container sections with such a hexagonal shape, the positive release can be achieved in directions rotated through 60° relative to one another and around the centre line C of the container.

The plates forming the sides of the container can also be modified so that they are slightly convex, seen from the centre line C of the container.

The container can also be modified in such a manner that at least two container sections in succession are given an alternating positive release in different directions, and that preceding or following container sections are given another shape.

While the present invention has been described in accordance with preferred compositions and embodiments, it is to be understood that certain substitutions and alterations may be made thereto without departing from the spirit and scope of the following claims.

What is claimed is:

1. A container for storing and discharging a particulate material, comprising:

an upper inlet end;

a lower discharge end disposed below the upper inlet end;

a container part for the particulate material, the container part being disposed between the inlet end and the discharge end, the container part comprising:

a first container section having a first cross-section;

a second container section, having a second cross-section being smaller than the first cross-section, the second container section being disposed below the first container section, the first and second cross-sections being polygonal and having at least four sides; and at least two opposite sides of the first and second container sections having successive diverging deflection surfaces extending along a center axis C in a direction from the inlet end to the discharge end.

2. The container according to claim 1 wherein the container has at least eight container sections.

3. A container for storing and discharging a particulate material, comprising:

an upper inlet end;

a lower discharge end disposed below the upper inlet end;

a container part for the particulate material, the container part being disposed between the inlet end and the discharge end, the container part comprising:

a first container section having a first cross-section;

a second container section, having a second cross-section being smaller than the first cross-section, the second container section being disposed below the first container section, the first and second cross-sections being polygonal and having at least four sides; and at least two opposite sides of the first and second container sections having successive diverging deflection surfaces extending along a center axis C in a direction from the inlet end to the discharge end, at least two opposite sides forming a deflection angle that is between 2–10 degrees relative to the center axis C.

4. The container according to claim 3 wherein the deflection angle is about 5 degrees.

5. The container according to claim 3 wherein the container comprises a plurality of successive container sections that have alternating diverging surfaces and converging surfaces on opposite sides of the center axis C.

6. The container according to claim 5 wherein the container has a rectangular cross section and at least five container sections.

7. A container for storing and discharging a particulate material, comprising:

an upper inlet end;

a lower discharge end disposed below the upper inlet end;

a container part for the particulate material, the container part being disposed between the inlet end and the discharge end, the container part comprising:

a first container section having a first cross-section;

a second container section, having a second cross-section being smaller than the first cross-section, the second container section being disposed below the first container section, the first and second cross-sections being polygonal and having at least four sides; and at least two opposite sides of the first and second container sections having successive diverging deflection surfaces extending along a center axis C in a direction from the inlet end to the discharge end, first opposite sides having diverging deflection surfaces and second opposite sides having converging deflection surfaces.

8. The container according to claim 7 wherein the diverging deflection surfaces form a diverging angle that is between 20–45 degrees relative to the center axis C.

9. The container according to claim 8 wherein the diverging angle is about 29 degrees.

10. The container according to claim 7 wherein each container section comprises two sides with diverging deflection and two sides with converging deflection so that each successive container section has its successive opposite diverging sides alternate between diverging deflection and converging deflection as the container extends along the center axis C.

* * * * *